United States Patent [19]

Corgnet

[11] 3,961,592

[45] June 8, 1976

[54] QUICK RELEASE

[75] Inventor: Jean-Louis Corgnet, Boulogne, France

[73] Assignee: Compagnie Francaise des Petroles, Paris, France

[22] Filed: Apr. 4, 1974

[21] Appl. No.: 458,002

[30] Foreign Application Priority Data

Apr. 10, 1973 France ..... 73.12915

[52] U.S. Cl. ..... 114/206 R; 114/221 A

[51] Int. Cl.[2] ..... B63B 21/24

[58] Field of Search..... 114/206 R, 230, 221 A, 114/206 A; 294/83 AE; 89/1 B ; 102/70.2 R

[56] References Cited

UNITED STATES PATENTS

| | | | |
|---|---|---|---|
| 3,130,703 | 4/1964 | Thompson | 114/206 R |
| 3,138,778 | 6/1964 | Dulin | 9/8 R |
| 3,151,594 | 10/1964 | Collipp | 114/206 R |
| 3,675,578 | 7/1972 | Douglas et al. | 102/70.2 R |

*Primary Examiner*—Duane A. Reger
*Assistant Examiner*—Gregory W. O'Connor
*Attorney, Agent, or Firm*—Ernest F. Marmorek

[57] ABSTRACT

A quick release device for a line to be subjected to tension, and a method for using the device wherein a remotely generated control signal is received by a control signal receiver which acts to detonate an explosive charge thereby to open, remotely, a tension transmitter or link, in the line.

15 Claims, 18 Drawing Figures

QUICK RELEASE

BACKGROUND OF THE INVENTION

The invention relates to a quick release device particularly suited for anchor lines, and in particular to the quick release of anchorage lines to ships, platforms and all marine drilling appliances. The invention also relates to a method of anchorage.

The need to release a drilling appliance arises, for example, in the case of uncontrolled eruption of the well. It may also arise when the appliance is in a zone in which icebergs are liable to drift.

As these appliances are fastened to eight to ten anchorage lines consisting of large-diameter cables or large-link chains, a relatively long period of at least ten hours is required before the appliance can be released. As it is fastened to anchorage lines arranged in several directions, the appliance cannot be positioned vertically over each anchor so as to be able to pull it away from the bottom and weigh it. It is therefore necessary to have recourse to a service barge which lifts each anchor, one after the other, to enable each anchor line to be taken on board. This operation requires a relatively calm sea, as the service barge must recover the marker-buoy to which the cable fastened to the crown of the anchor is attached. It will easily be appreciated that in the case of a bad sea, the drilling appliance is immobilized for several days, or even several weeks, with the risks which attend this immobilization in swells sometimes attaining 25 metre troughs, before this operation can be carried out. Given the very high cost of hire of drilling appliances, more than one hundred-thousand francs per day, the economy realized by instant release of the anchorage will be appreciated.

SUMMARY OF THE INVENTION

According to the present invention there is provided a quick release device for a line to be subjected to tension, the device comprising a body, a chamber in the body for a control signal receiver, coupling means for applying the body to the line, a tension transmitter coupled to the body which will be subject to the tension of the line, at least one chamber in the tension transmitter for receiving an explosive charge, and a detonator chamber in the body which is positioned relative to the tension member to direct a shock wave produced by firing a detonator in the detonator chamber to the explosives chamber of the tension transmitter to detonate a charge when present to thereby break the tension transmitter and hence release the line.

According to the invention there is further provided a method of quick release anchoring a vessel, platform or rig comprising dropping an anchor coupled to the vessel, platform or rig through a line and a quick release device as defined in the preceding paragraph, and positioning a signal transmitter at the surface to which a receiver in the body will respond to fire a detonator in the body and explode the charge in the tension transmitter.

In using the quick release device for a marine anchor line, the signal, which is preferably acoustic, may be transmitted through the water or directly by the chain or cable fixed to the anchor. All risks of defective transmission of the arcoustic signal direct in the water can thus be eliminated.

Moreover, as the pin carrying the explosive charge is subjected to pure traction or shearing stresses, complete separation of the anchor line and the anchor is ensured by simple appropriate arrangement of the explosive charges to prevent the survival of any metal fragment which could hold together the parts originally belonging to the pin.

BRIEF DESCRIPTION OF THE DRAWINGS

In order that the invention may be well understood there will now be described some embodiments thereof, given by way of example only, with reference to the attached drawings, in which.

DESCRIPTION OF THE PREFERRED EMBODIMENTS AND OPERATION

Figure 1:
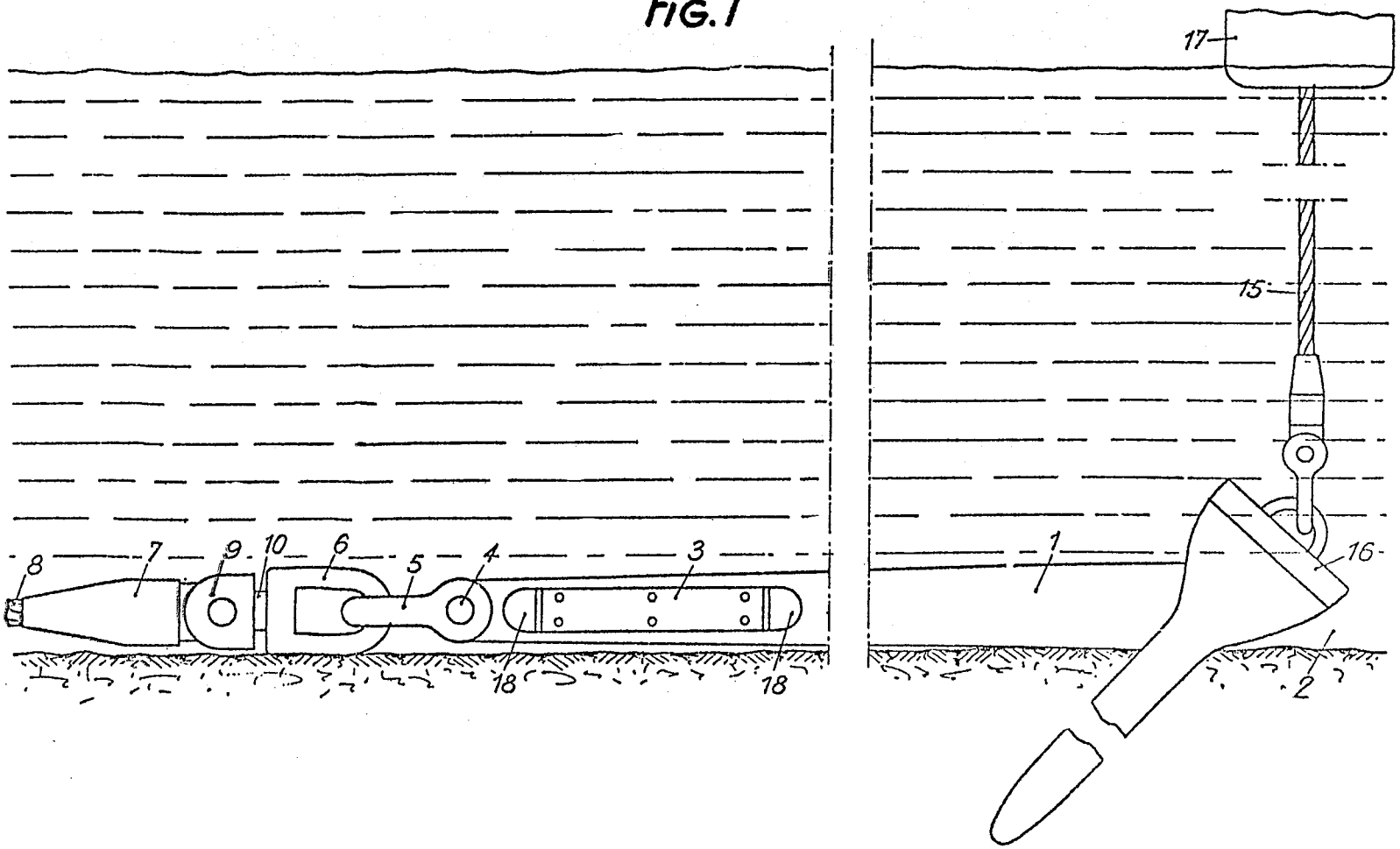
FIG. 1 is a diagrammatic representation of an anchor provided with an embodiment of quick release apparatus according to the invention.
Figure 10:
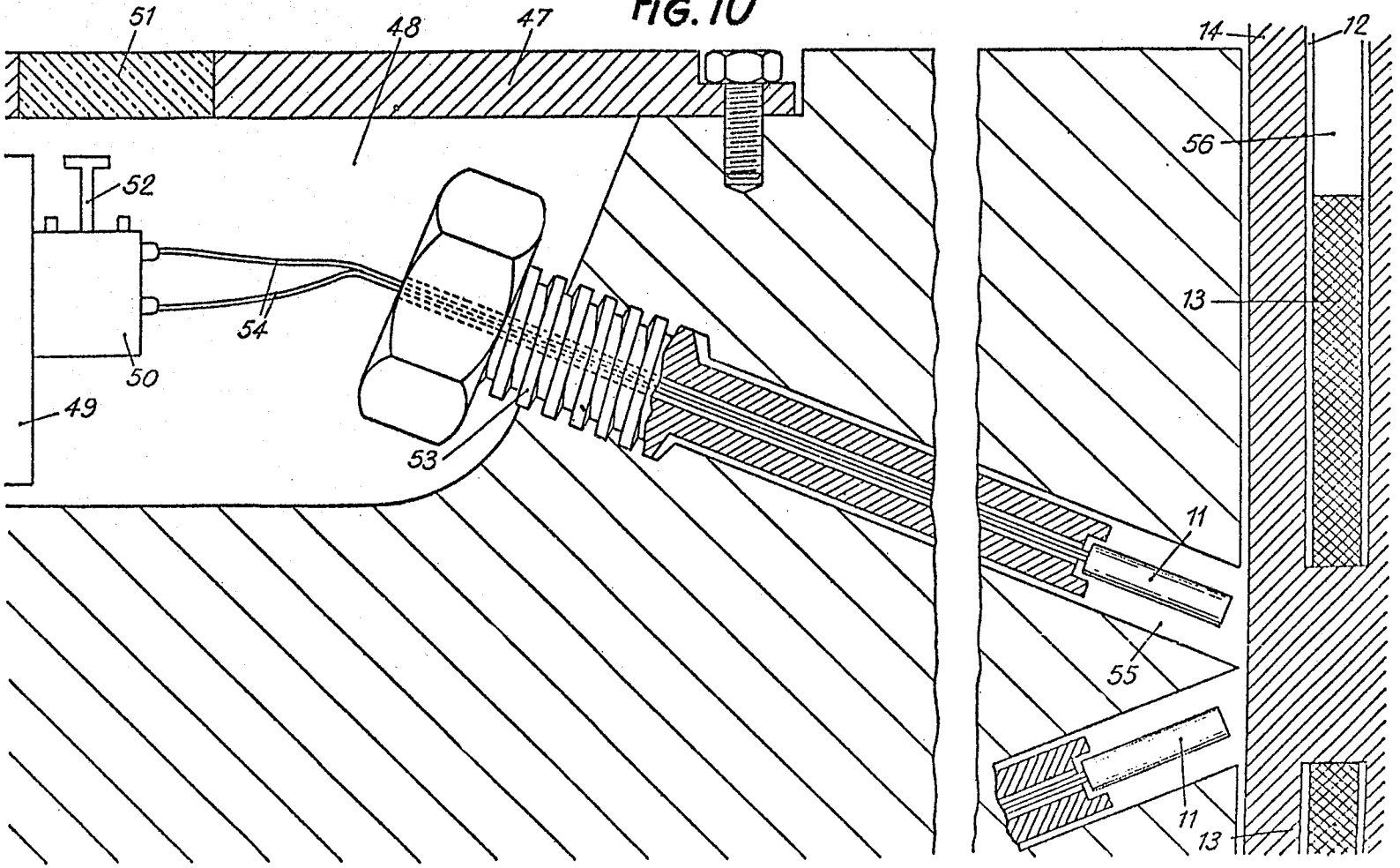
FIG. 10 an enlarged view of the apparatus of FIG. 1.

In order to facilitate the disclosure, reference will be made to the diagram of FIG. 1 showing an anchor 1 resting on the sea bed 2. This anchor is equipped with an apparatus 3 comprising at least one receiver apparatus for preferably encoded ultra-sonic signals, triggering the closure of a circuit for firing the detonator situated adjacent to the pin 4 of the shackle 5. The annular portion of the latter passes into the ring 6 of a clinch shackle attached to the fastener 7 of the cable 8 by the piece 9 whose traction pin 10 swivels in the shackle 6. The apparatus 3 is so formed that the detonator, which may be similar to the one shown at 11, FIG. 10, is adjacent to the pin 4, the latter having at least one longitudinal housing such as 12 for the location of an explosive charge 13. In order to obtain reliability, the pin 4 like the pin 14 of FIG. 10 has two explosive charges 13 so that each end of the pin is sheared by the explosion, thus rendering the shackle 5 completely separate from the shank of the anchor 1 carrying the release apparatus 3.

The receiver of the apparatus 3 can be any commercial receiver of ultrasonic waves in the form of encoded signals. As to the detonator, the optional delay devices and the explosive charges, it is known that all these products are known and commercially available. As the invention does not relate to these products per se and does not suggest any change in composition, there is no purpose in giving this part of the description in greater detail. It will only be noted that the apparatus 3 has the batteries necessary for firing the detonator and that advantage is taken of the metallic continuity existing between the receiver of the apparatus 3 and the surface appliance to transmit the encoded signal from the drilling appliance whenever transmission by water is not reliable enough. A particular encoded signal may be available for each anchor line so as to selectively release the selected line and, if required, a common signal may be available for the simultaneous release of all the lines, either immediately or with a certain delay. This delay may be incorporated in the release apparatus itself and be different for each line. Also, if it is not desired to release all the anchors simultaneously, each receiver may be controlled individually by the cable 15 secured to the crown 16 of the anchor 1 and supported by the marker-buoy 17, the signal being given by the service barge. However, whatever the selection made and in order to prevent any possible defect in the operation of the apparatus 3, a second receiver arranged adjacent to the first and acting on an independent detonator is used for safety. In the embodiment shown in FIG. 1, the apparatus 3 is housed in a protective case the shape of whose ends 18 enables any fouling of the apparatus to be avoided when the anchor rubs on the sea bed or digs into it.

Figure 2:
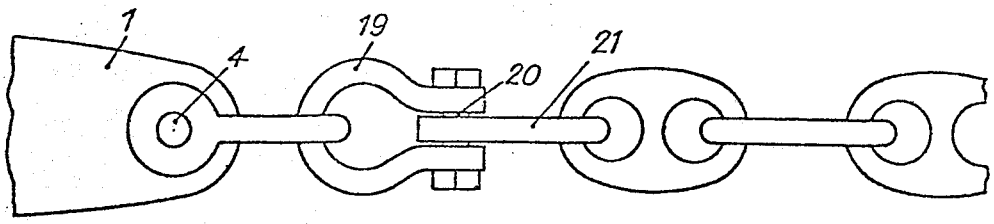
FIG. 2 a view of the anchor with a portion removed showing the shank portion of the anchor.

The embodiment shown in FIG. 2 is in fact practically identical to that of FIG. 1. There is again shown the shank of an anchor 1 with its pin 4 provided with two explosive charges (not shown) to obtain the shearing of each end, a shackle 19 with a threaded pin 20 acting as a fastening to the first link of the chain 21 of the drilling appliance.

Figure 3:
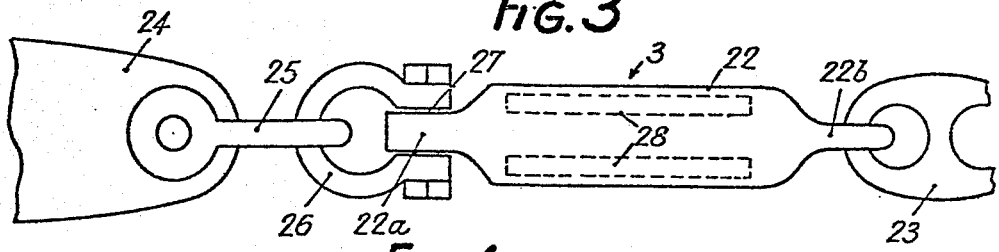
FIGS. 3 to 9, seven modifications of the embodiment of FIG. 2.

In accordance with a preferred embodiment of the invention, the release apparatus 3 forms a body 22, FIG. 3, provided at each end with a ring 22*a* or 22*b*. The ring 22*b* is connected to the anchor chain by a conventional shackle or a Kenter shackle 23 for example, in which the dove-tail assembly of the detachable parts permits an excellent connection means. The ring 22*a* is adjacent to the anchor 24 and is fastened to the shackle 25 of the latter by a shackle 26 whose threaded pin 27 carries explosive charges. The two receivers have been shown in broken lines 28. The advantage of this embodiment is that it facilitates mounting of the apparatus 22, since all that is necessary to place it in position is to fasten it by the ring 22*b* to the shackle 23 on the chain side and to then attach the ring 22*a* to the anchor by the shackle 26.

Figure 4:
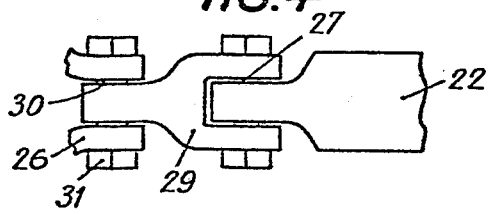

In order to avoid having to manipulate the pin 27 carrying explosive charges during this last connection phase, an intermediate link 29 is added in accordance with the embodiment of FIG. 4. It is then only necessary to manipulate the threaded pin 30 having no charge so that no special precaution has to be taken on tightening of the fixing nuts 31 or any similar means at the moment of fastening of the shackle 26 and the shackle 25 of the anchor 24.

Figure 5:
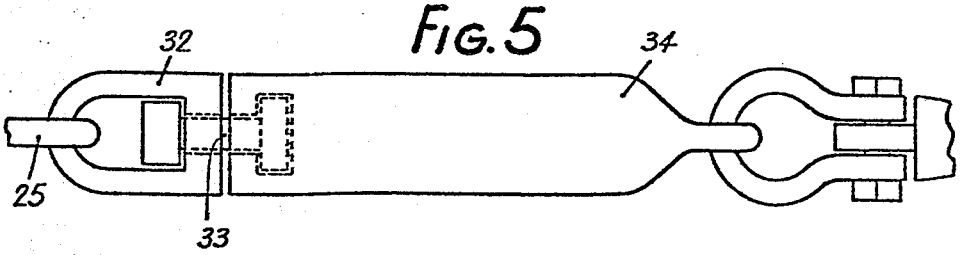
Figure 6:
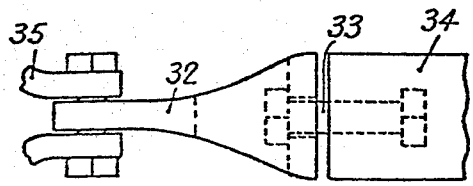

In the embodiment of FIG. 5, the ring 22*a* has been replaced by an incorporated shackle 32 which may or may not turn about its detachable pin 33 connecting the shackle 32 to the control apparatus 34. In this arrangement, the explosive charge is arranged in a longitudinal housing in the traction pin 33. As the pin 33 only works in traction and no longer in shear, like the pins 20 or 27, a single charge is sufficient to ensure the breakage and separation of the parts snapped by the explosion, separation being facilitated, moreover, by the traction applied by the chain or cable in the direction of the anchor line employed.

To increase the safety of the apparatus at the moment of handling still more, the control apparatus 34 is connected to the ring 25 by an intermediate shackle 35.

Figure 7:
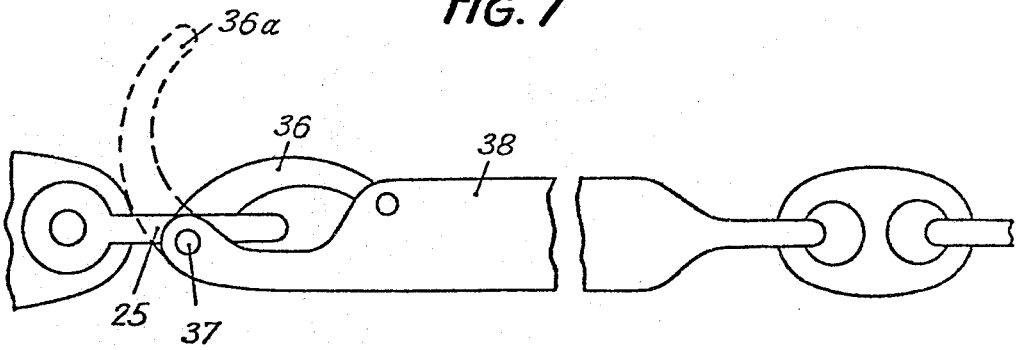
Figure 8:
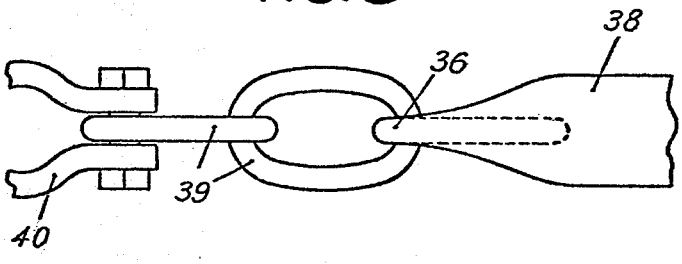

The ring of the apparatus adjacent to the ring 25 of the anchor can also be replaced by a hook 36 pivoting about a pin 37, as in the case of the apparatus 38 of FIG. 7. The end 36*a* of the hook 36 may be attached to the body of the apparatus 38 in several ways. For example, 36*a* may be traversed by a pin whose ends bear on the body of the apparatus 38 or may also be held in the shut-down position by a pin, one end of which is fixed to the end 36*a* and the other end to an attachment point on the case of the apparatus 38. However, whatever the method in question: a pin working in shear in the first case, a pin working in traction in the second case, it is this pin which contains the explosive charge. Although this pin is fairly well protected, rings 39 and a shackle 40, FIG. 8, may also be provided between the ring 25 of the anchor and the hook 36.

Figure 9:
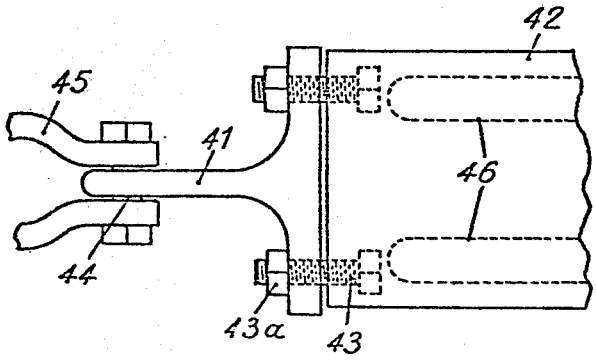

In the modification of FIG. 9, one of the rings of the apparatus 42 is replaced by a detachable piece 41. This piece, fixed to the body 42 by the bolts 43 and the nuts 43*a*, has a passage for attachment of the threaded pin 44 of an anchor attachment shackle 45. As before, the receivers 46 trigger the firing of the explosive charges on this occasion incorporated in the bolts 43.

Figure 13:
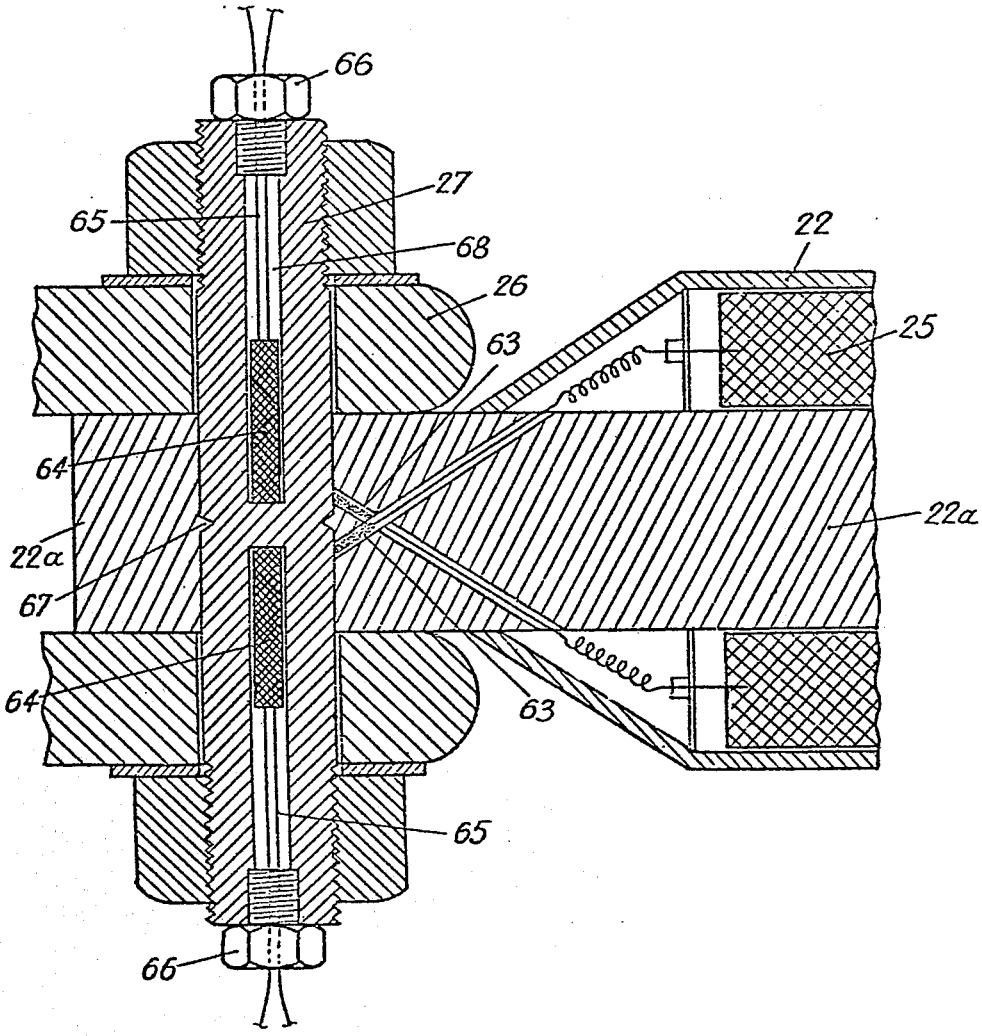
FIG. 13 and enlarged view of the control mechanism of the apparatus shown in FIG. 3.

Whether it is a question of the anchor itself or of apparatus such as 22, 34, 38 or 42, as shown in FIG. 10, there is again a protective casing 47, a housing 48 containing at least one receiver 49, a switch 50, a means for access 51 to the lever 52 of the switch 50 and a threaded and hollow pin 53 for passage of the wires 54 of the control circuit of the detonator 11. The latter, held at the end of the threaded pin 53, is situated in a detonation chamber 55 extending the bore of the threaded pin and emerging onto the central portion of the pin 14 carrying the charges 13. The latter may be retained by any suitable inert body 56. The shock wave due to the detonation of the detonators 11 causes the explosion of the charges 13. The pin 14, like the pin 27 of FIG. 13, may bear a groove similar to the groove 67.

Figure 12:
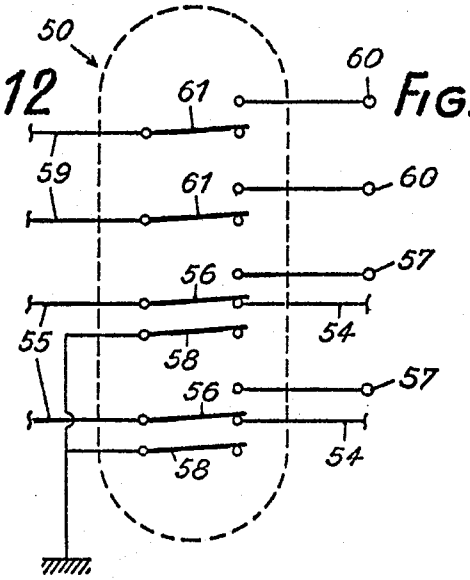
FIGS. 11 and 12 diagrammatic representations of a switch for checking the electrical equipment.
Figure 11:
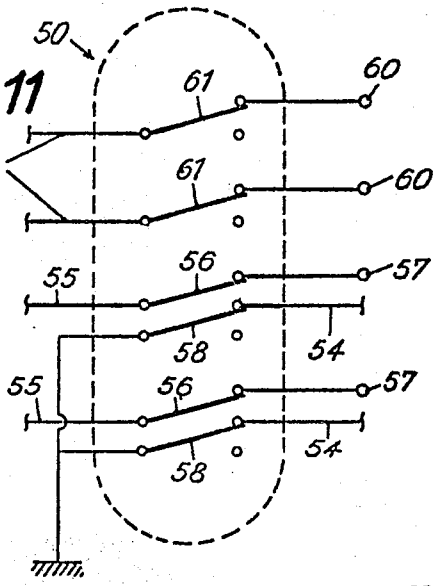
Figure 18:
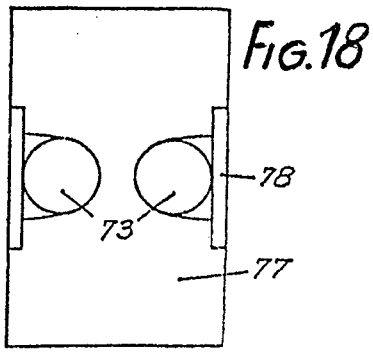
FIGS. 15 to 18 four modifications of the method for inserting the receiver apparatus of the control apparatus.
Figure 17:
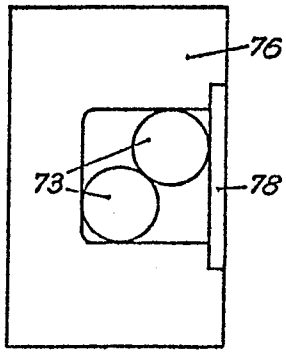
Figure 16:
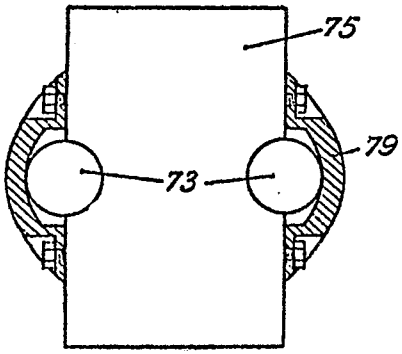
Figure 15:
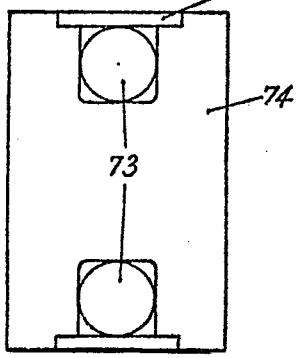

The two switching positions of the switch 50 have been shown diagrammatically in FIGS. 11 and 12. In the position for checking the circuits of FIG. 11, the wires 55 for transmission of the firing order are connected by the switch-bars 56 to the external terminals 57. The wires 54 connected to the detonator are short-circuited and earthed by the bar 58. The voltage transmitted by the wires 59 for connection to the battery is available at the terminals 60 via the bars 61. In the second position: FIG. 12, the firing signal is transmitted directly from wires 55 to wires 54 by the bars 56 while the terminals 57 and 60 are again isolated.

It will be noted that the detonators are always arranged between the receiver and the charge-carrying pin inside a housing in a body subjected to the traction of the anchor line. If the case is taken of the release apparatus 22 of FIG. 3, a portion of which has been shown in section in FIG. 13, it will be observed that the detonators 63 are housed in the portion 22*a* and that their housings emerge onto the pin 27 carrying charges 64. These charges, which are retained by the supports 65 and the bolts 66, are positioned adjacent to the detonators and in a part working in shear caused by the stresses of the shackle 26 and the ring 22*a*. A groove 67 may be formed on the pin 27 to favour breakage of this portion. Any packing may be arranged at 68.

Figure 14:
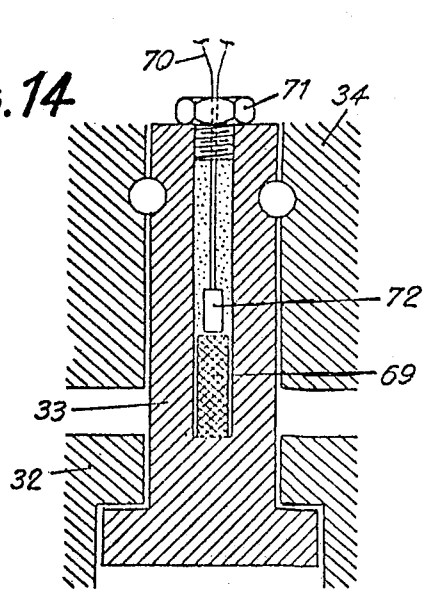
FIG. 14 a view of the control mechanism of the apparatus of FIG. 5.

The above arrangement re-appears similarly in the release apparatus 34 of FIG. 5, as shown by the detail of FIG. 14, although the pin 33 carrying the charge 69 is on this occasion a pin subjected only to traction stress. The wires 70 connected to the firing apparatus of the receiver pass through the bolt 71 and hold in position the detonator 72 which explodes the charge 69. The latter is arranged in a zone situated in a portion of the pin between the body 34 and the shackle 32.

It is clear that the receivers may be arranged in any position in the release apparatus and preferably adjacent to the outer protective casing. FIGS. 15 to 18 give examples of the arrangements of the receivers 73 in sections of the release apparatus 74 to 77, the protective casings 78 or 79 being adapted to either the internal or external method of attachment.

What I claim is:

1. A quick release device for a marine anchor line under tension, comprising, in combination:

an anchor including a shaft;

said shaft having defined therein first and second chambers and a bore;

a control signal receiver disposed in said first chamber and operative to receive a predetermined signal and produce an output signal in response thereto; and coupling means operative for connecting said anchor to said anchor line;

said coupling means comprising a tension transmitter coupled to said anchor and subject to the tension in said anchor line;

said tension transmitter including a pin extending into said bore and said tension transmitter having defined therein at least one cavity for receiving an explosive charge; said second chamber being disposed relative to said cavity so that a shock wave produced by a detonator exploded in said second chamber by said output signal will detonate an explosive in said cavity, whereby said anchor is disconnected from said anchor line.

2. The quick release device as claimed in claim 1, wherein said tension transmitter comprises at least one retaining member received by an opening defined in said shaft.

3. The quick release device as claimed in claim 2, wherein said second chamber interconnects to said opening.

4. The quick release device as claimed in claim 2, wherein said shaft is elongated and said opening is substantially coaxial therewith.

5. The quick release device as claimed in claim 2, wherein said shaft is elongated and said opening is normal thereto.

6. The quick release device as claimed in claim 5, further comprising a shackle couple to said shaft by said retaining member for the interconnection between said shaft and said anchor line.

7. The quick release device as claimed in claim 1, wherein said tension transmitter comprises a coupling piece connected to said shaft by at least one retaining member, said retaining member including a bolt having a third chamber defined therein for receiving another explosive charge.

8. The quick release device as claimed in claim 2, wherein said control signal receiver is an acoustic receiver.

9. The quick release device as claimed in claim 8, wherein said acoustic receiver is accessible through an opening defined in said shaft normally closed by a cover plate.

10. The quick release device as claimed in claim 1, wherein said shaft includes switch means selectively operable to couple the output signal to said detonator or to test equipment.

11. The quick release device as claimed in claim 1, further comprising a second control signal receiver.

12. A method of quick release anchoring for a vessel, platform, or rig wherein an anchor having defined therein first and second chambers is connected by coupling means to an anchor line under tension, said coupling means comprising a tension transmitter subject to the tension of said anchor line and having at least one cavity defined therein; said method comprising the steps of:

transmitting a signal to a control signal receiver disposed in said chamber and operable for producing an output signal in response thereto;

conducting said output signal to a detonator disposed in said second chamber and operable to explode in response thereto; and disposing an explosive charge in said cavity so that it will be exploded by the shock wave produced by said detonator, whereby said anchor is disconnected from said anchor line.

13. The method as claimed in claim 12, further comprising connecting said anchor to a marker buoy with a suspension cable and transmitting a signal to said control signal receiver through said suspension cable.

14. The method as claimed in claim 12, wherein the firing of said detonator is interrupted and the output signal of said control signal receiver is tested to determine if it is within a predetermined operating range.

15. The method as claimed in claim 12, wherein said control signal receiver is an acoustic receiver for receiving a predetermined coded signal so that a plurality of control signal receivers or a plurality of quick release anchoring can be used with the selective release by means of a transmitted coded signal.

* * * * *